United States Patent [19]

Mightly

[11] 4,178,684

[45] Dec. 18, 1979

[54] COMFORT GRIP CUTLERY

[76] Inventor: Pamela Mightly, 1770 Grand Concourse Apt. #5D, Bronx, N.Y. 10457

[21] Appl. No.: 894,912

[22] Filed: Apr. 10, 1978

[51] Int. Cl.[2] ..... B25G 3/00

[52] U.S. Cl. ..... 30/344; 30/340; 30/345; 145/61 C; 145/108 R

[58] Field of Search ..... 30/344, 340, 342, 343, 30/345; 145/61 C, 108 R

[56] References Cited

U.S. PATENT DOCUMENTS

| | | | |
|---|---|---|---|
| 140,997 | 7/1873 | Eddy | 30/343 |
| 298,829 | 5/1884 | COX | 30/340 |
| 356,453 | 1/1887 | Cox | 30/340 |
| 673,506 | 5/1901 | Pitts | 30/340 |
| 1,997,131 | 4/1935 | Champlin | 30/342 |
| 2,073,618 | 3/1937 | Askue | 30/342 |
| 2,205,769 | 6/1940 | Sweetland | 145/61 C |
| 2,352,013 | 6/1944 | Roth | 30/340 |
| 2,650,426 | 9/1953 | Montelius | 30/340 |
| 3,387,368 | 6/1968 | Scheck | 30/345 |

FOREIGN PATENT DOCUMENTS

| | | | |
|---|---|---|---|
| 910205 | 4/1954 | Fed. Rep. of Germany | 30/340 |
| 922334 | 1/1955 | Fed. Rep. of Germany | 30/340 |

*Primary Examiner*—Robert L. Spruill
*Assistant Examiner*—J. T. Zatarga
*Attorney, Agent, or Firm*—Richard L. Miller

[57] ABSTRACT

A cutlery knife that includes a blade set in a handle, and the handle having a new shape that is more comfortable for being held in a hand; the handle including a depression on each opposite side that serves to receive the thumb so to provide a more natural grip and an upper edge of the handle having a depression near its forward end into which a tip of a finger can be placed to serve as a fulcrum point in handling the knife and providing a more firm grip, the depressions being Teflon coated.

2 Claims, 5 Drawing Figures

COMFORT GRIP CUTLERY

This invention relates generally to cutlery knives.

A principal object of the present invention is to provide a cutlery knife having a handle which is more comfortable to being gripped in a hand while being used, so that it is not tiring when being used for a long period of time and which gives a more positive grip so that there is no danger of slipping from a grasp thereof.

Another object is to provide a comfort grip cutlery in which the knife handle includes a depression on each side for receiving a person's thumb whether held in either a right or left hand, the depression allowing a more natural grip.

Another object is to provide a comfort grip cutlery in which a depression along a forward portion of the upper edge permits a more firm, non-slip grasp of the handle.

Still a further object is to provide a comfort grip cutlery in which the handle depressions are coated with a Teflon, so to prevent the development of blisters on a person's fingers engaging the surfaces thereof.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figures 1, 2, 3, 4, 5:
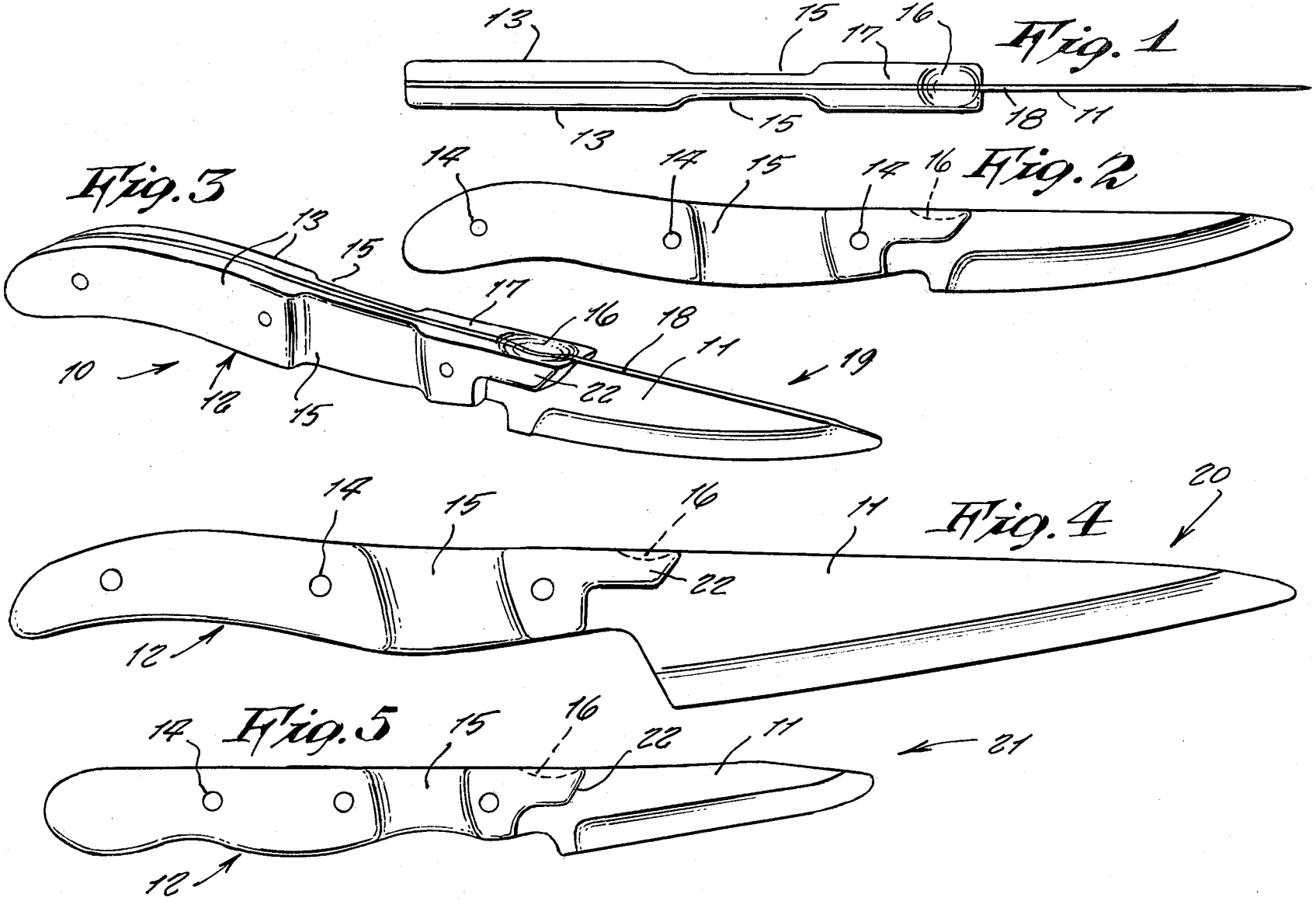
FIG. 1 is a top edge view of a paring knife incorporating the present invention.
FIG. 2 is a side view thereof.
FIG. 3 is a perspective view thereof.
FIG. 4 is a side view showing the invention incorporated in a carving knife.
FIG. 5 is a side view of a small utility knife incorporating the invention.

Referring now to the drawing in greater detail, and more particularly to FIGS. 1 to 3 thereof at this time, the reference numeral 10 represents a comfort grip cutlery according to the present invention wherein there is a knife blade 11 fitted at one end in a handle 12 comprised of opposite side plates 13 secured together by transverse rivets 14. The blade is of steel and the handle plates may be made of wood or other desirable material.

In the present invention the handle includes a transverse depression 15 on each outer face and which extends across a longitudinal intermediate portion thereof. The depressions serve for a synthetic resin polymer such as person's thumb to fit therein, and by including a depression on each opposite side, allow the handle to be held in either a left or right hand.

Another small depression 16 is provided at a forward end of a top edge 17 of the device handle, the depression being comprised of aligned notches in each plate and a notch in the upper edge 18 of the blade. The depression 16 serves for the end of a finger to be rested therein to give a non-slip firm grasp of the handle.

The surfaces of the depressions 15 and 16 are coated with a film of Teflon so to give a smoothness that will prevent devloping blisters on fingers.

A paring knife 19 is shown in FIGS. 1 to 3.

In FIG. 4, the present invention is incorporated in a carving knife 20. In FIG. 5, the invention is incorporated into a small utility knife 21.

It is to be noted that in each of these knives, the forward end of the handle plates comprises a narrow extension 22 having its upper edge align with the upper edge of the blade, the forward end edge of the extension being precisely vertically aligned with a rear end of the blade cutting edge, and the depression 15 accordingly being vertically aligned immediately just rearwardly of the blade cutting rear end. The depression 15 also is intended to serve as a non-slip fulcrum about which the knife can be vertically pivotable when used in various tasks such as paring vegetables and the like.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A comfort-grip cutlery, comprising in combination, a knife including a steel blade and a handle at one end of said blade, said handle being comprised of a pair of plates positioned on opposite sides of said blade therebetween, a single, longitudinally extending depression on an outer side of each said plate for receiving either a right or left hand thumb, said depressions extending a full length vertically between an upper and lower edges of said plates and extending across a longitudinally intermediate portion of said handle, and a depression upon an upper edge of said handle for receiving a finger tip, wherein the last said depression for receiving a finger tip on said handle upper edge is at a forward extension of the handle over the top of the blade and includes at the center of said finger tip depression a depression in the top of the blade, said finger tip depression being oval-shaped at its edge and downwardly inclining toward the center thereof.

2. The combination as set forth in claim 1 wherein said depressions are coated with a synthetic resin polymer.

* * * * *